US006696977B2

(12) United States Patent
Thompson et al.

(10) Patent No.: US 6,696,977 B2
(45) Date of Patent: Feb. 24, 2004

(54) AUTOMATIC GATE CONTROL SYSTEM FOR FREEWAY INTERCHANGES

(75) Inventors: Gregory E. Thompson, St. Paul, MN (US); Matthew J. Via, Medina, MN (US)

(73) Assignee: ThomTech Design, Inc., St. Paul, MN (US)

( * ) Notice: Subject to any disclaimer, the term of this patent is extended or adjusted under 35 U.S.C. 154(b) by 134 days.

(21) Appl. No.: 10/120,062

(22) Filed: Apr. 10, 2002

(65) Prior Publication Data

US 2003/0201907 A1 Oct. 30, 2003

(51) Int. Cl.[7] ..... G08G 1/09

(52) U.S. Cl. ..... 340/905; 256/13.1; 340/908.1; 404/6; 404/9

(58) Field of Search ..... 340/905, 908.1, 340/909, 910, 915, 917, 928, 937; 701/117; 318/285, 283, 286, 139, 466, 469; 404/6, 9; 256/13.1

(56) References Cited

U.S. PATENT DOCUMENTS 3,886,519 A * 5/1975 Hovland ..... 116/63 P
5,425,595 A * 6/1995 Roper ..... 404/9
5,551,796 A * 9/1996 Anderson, Jr. et al. ..... 404/6
5,982,298 A 11/1999 Lappenbusch et al. ..... 340/905
6,091,217 A * 7/2000 Parsadayan ..... 318/285
6,108,554 A 8/2000 Kawamoto ..... 455/456
6,158,696 A * 12/2000 Brodskiy ..... 404/6
6,317,058 B1 11/2001 Lemelson et al. ..... 340/910
6,329,930 B1 * 12/2001 Parsadayan ..... 340/933
6,626,606 B1 * 9/2003 Johnson ..... 404/6

* cited by examiner

*Primary Examiner*—Brent A. Swarthout
(74) *Attorney, Agent, or Firm*—Nikolai & Mersereau, P.A.; Thomas J. Nikolai

(57) ABSTRACT

A freeway interchange traffic rerouting control system allows individual ones of the gates and signs to be operated from a workstation connected via the Internet to a web server and communications server that control spread spectrum radio transceivers. A system operator logs onto the Internet, proceeds to the interchange URL where a control panel and video screen appear. Signals may be sent from the workstation to a web server to operate the gates and to turn on advanced warning signs. Video feeds from strategically located cameras allow for viewing traffic activity at the intersection at the remote workstation. Provision is also made for detecting instances of violations whereby an alarm is given and the video detailing the violation is captured for analysis.

10 Claims, 5 Drawing Sheets

AUTOMATIC GATE CONTROL SYSTEM FOR FREEWAY INTERCHANGES

BACKGROUND OF THE INVENTION

I. Field of the Invention

This invention relates generally to highway traffic control systems, and more particularly to an automated gate operations system for controlling vehicle traffic flow at freeway interchanges, whereby traffic can be excluded from predetermined segments of the freeway.

II. Discussion of the Prior Art

In the event of ice storms or heavy snowstorms, it may prove dangerous, or even life-threatening, to allow vehicles to drive on ice and/or snow-covered freeways. Then, too, the job of snow and ice removal is greatly facilitated if the freeway stretches to be cleared are free of traffic. With passenger cars and commercial vehicles absent, multiple highway maintenance trucks equipped with plows and sand spreaders can drive in parallel to span all freeway lanes from a shoulder to a median strip to clear ice and snow in one pass. The trucks can travel at a relatively high speed, which cannot be done if the maintenance vehicles must maneuver to avoid other vehicles.

In shutting down a section of freeway to traffic, it has been the past practice, in regions where snow and ice are common, to provide manually operable gates having a barrier arm which would typically be lowered across freeway entrance ramps and across the freeway driving lanes by state highway patrol personnel upon receiving a verbal broadcast message from an authorized official of the state's Department of Transportation.

It has also been the past practice to have warning signs positioned up road from the freeway exit and entrance ramps to advise drivers that they must leave the freeway at the next exit. These signs are normally covered by a hinged panel that would have to be manually dropped by state patrol personnel in order to display the warning message.

It is also old in the art to provide TV cameras at strategic locations along a freeway. These cameras are adapted to transmit video data to a highway department facility so that traffic levels, and sometimes traffic violations, can be remotely monitored. The Moore U.S. Pat. No. 5,729,214 describes a remotely controlled message display system having lighted signs that allow a plurality of different messages to be displayed by selected illumination of a plurality of lamps. Such signs frequently are used to indicate levels of congestion, the location of accident scenes, road conditions, etc. A satellite-based communications system is used to transmit data to electronic circuits in the signs themselves to control the wording of the message to be displayed.

The Lemelson et al. U.S. Pat. No. 6,317,058 describes a traffic regulating system also involving geostationary satellites for monitoring traffic flow and controlling traffic lights and warning signs. The patent also teaches the use of video cameras strategically positioned over or next to a roadway along with means for transmitting video data streams to a central site.

Thus, while prior art patents disclose various systems for monitoring and controlling traffic flow that use automated warning signs, traffic monitoring video cameras and wireless communications links, we are not aware of any automatic system operated from a control center for rapidly, safely and automatically rerouting freeway traffic so as to shut down sections of freeway when they become unsafe due to snow and ice conditions, chemical spins, etc. where the control center is located remote from the affected interchanges. The present invention provides such a system.

SUMMARY OF THE INVENTION

The present invention comprises a freeway interchange traffic rerouting control system. The system comprises a plurality of motorized, radio-controlled gates that are located at freeway interchanges to selectively block traffic flow onto freeway entrance ramps and on freeway driving lanes, but not on the freeway's exit ramps. A radio transmitter is placed within range of the motorized radio-controlled gates. Completing the system is a control center having an INTERNET connection to a communications server for permitting authorized persons to cause predetermined coded signals to be transmitted by the radio transmitter to the plurality of radio-controlled gates for controlling the movement of the gates' barrier arms between a raised and a lowered traffic-obstructing disposition.

As a further embodiment, radio-controlled signs may be positioned up road from the interchange by a predetermined distance or more and when actuated, they provide a warning message to oncoming vehicle drivers when one of the radio-controlled gates receives a coded signal for effecting movement of its barrier arm to its lowered disposition.

Further enhancing the system is a plurality of video cameras that appropriately placed at the interchange to view each of the oppositely directed freeway driving lanes and the entrance ramps. Video data from the cameras is sent via a broadband radio link to a communications server having a connection to the INTERNET, whereby persons at a workstation at the control center may view events taking place at the interchange.

There are, of course, additional features of the invention that will be described hereinafter which will form the subject matter of the appended claims. Those skilled in the art will appreciate that the preferred embodiments may readily be used as a basis for designing other structures, methods and systems for carrying out the several purposes of the present invention. It is important, therefore, that the claims be regarded as including such equivalent constructions since they do not depart from the spirit and scope of the present invention. The foregoing and other features and other advantages of the invention will be apparent from the following more particular description of preferred embodiments of the invention, as illustrated in the accompanying drawings.

DESCRIPTION OF THE PREFERRED EMBODIMENT

Figure 1:
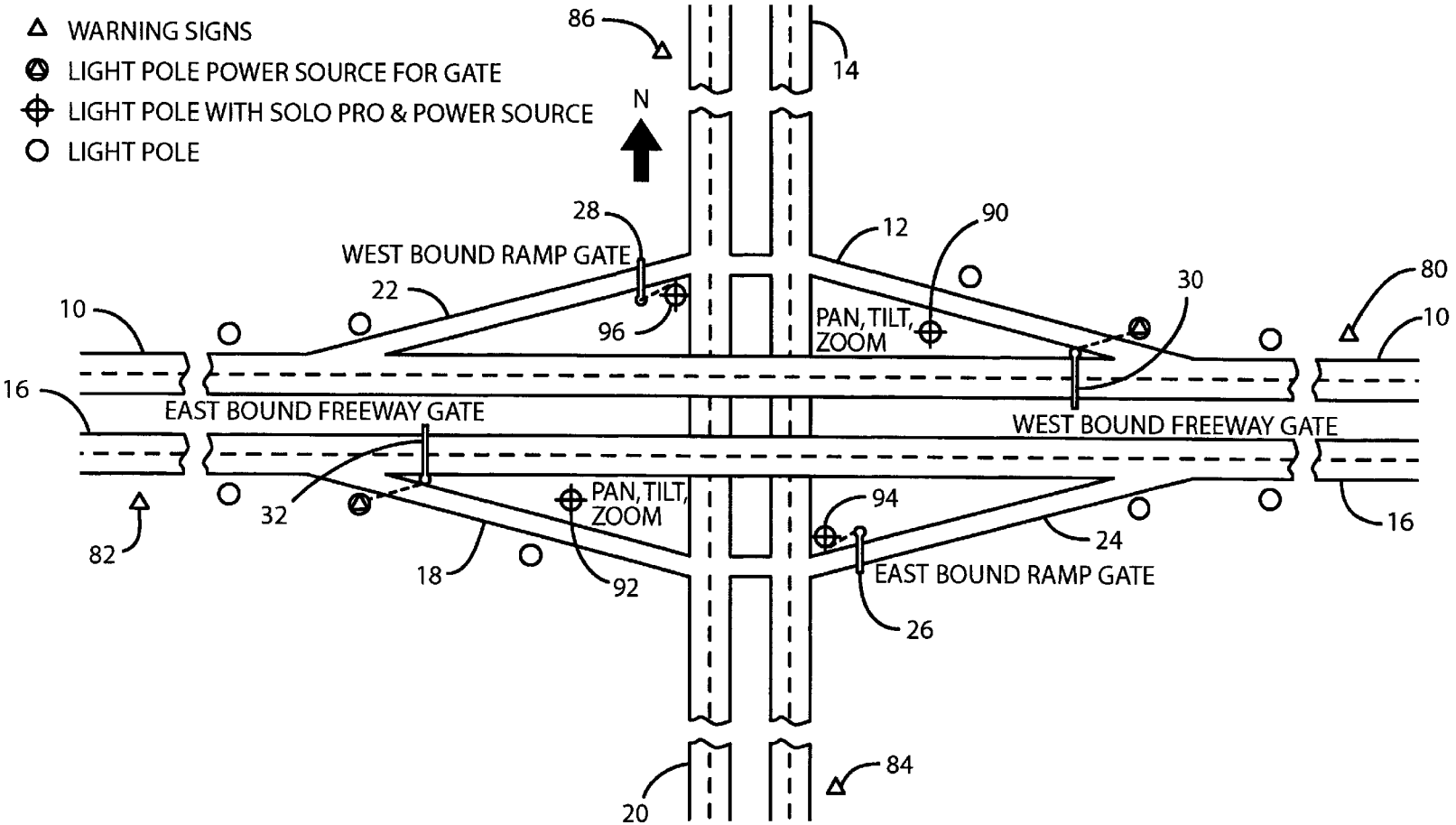
FIG. 1 is a top plan view of a typical freeway interchange showing schematically the location of gates, signs, and video cameras used in implementing the preferred embodiment of the present invention.

Referring to FIG. 1, there is shown an aerial view of a typical freeway interchange where the freeway, shown as running east-west, intersects with another freeway or U.S. highway shown as running north-south. The westbound lanes of the freeway or identified by numeral 10 and associated with it is an exit ramp 12 leading to the northbound lanes 14 of the intersecting highway. Likewise, the eastbound mainline lanes of the freeway are identified by numeral 16 and associated with it is an exit ramp 18 leading to the southbound lanes 20 of the intersecting highway. Connected between the southbound lanes 20 of the highway and the westbound mainline lanes 10 of the freeway is a freeway entrance ramp 22. An entrance ramp 24 is also provided between the northbound lanes 14 of the highway and the eastbound mainline lanes 16 of the freeway.

In order to shut down traffic flow on the freeway due to weather conditions, serious accidents or homeland security concerns, there are provided ramp gates, as at 26 and 28, for blocking the entrance ramps 22 and 24 while the exit ramps 12 and 18 remain open. Positioned a short predetermined distance down road of the exit ramp 12 of the westbound freeway lane 10 is a mainline gate 30. Similarly, a mainline gate 32 is disposed a short predetermined distance, e.g., 120 feet, down road of the exit ramp 18 from the eastbound mainline lane 16 of the freeway.

In accordance with the present invention, the gates 26, 28, 30 and 32 are automatic, radio-controlled barriers that under command of radio signals from a remotely located transmitter can be lowered from a raised disposition to effectively block the freeway entrance ramps 22 and 24 as well as the westbound and eastbound mainline freeway traffic lanes 10 and 16, respectively.

Figure 2:
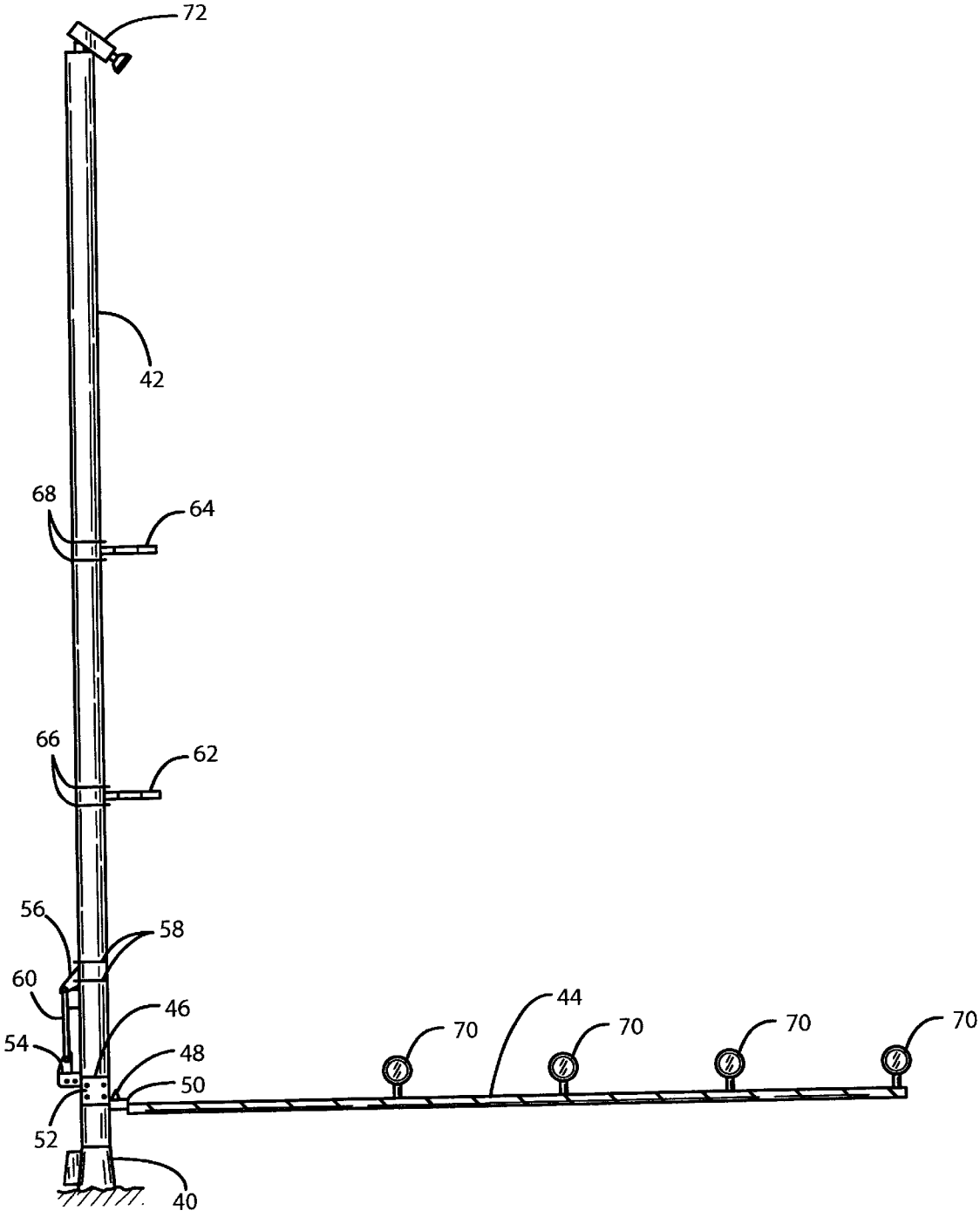
FIG. 2 is a side elevational view of a typical gate used in the system of FIG. 1.

Referring next to FIG. 2, there is shown a side elevational view of a typical one of the gates. It is seen to comprise a base 40 supporting a vertically disposed pole 42 to which a barrier arm 44 of a predetermined length is pivotally joined. The hinge joint comprises a pair of rectangular plates 46 that straddle and are clamped to the pole 42 to provide a bearing surface for a pair of trapezoidal hinge plates, as at 48, to which the barrier arm 44 is bolted by means of a bracket 50. A hinge pin 52 passes through sleeve bearings in the bearing plates 46 as well as through the trapezoidal hinge plates 48.

A further bracket 54 is fastened to the upper edge of the trapezoidal hinge plates 48. Located above the barrier arm mount on the pole 42 is a clevis arm 56 that is secured to the pole 42 by means of U-bolts as at 58. A linear actuator 60 is operatively coupled between the clevis arm 56 and the bracket 54 allowing the barrier arm 44 to be raised and lowered upon appropriate activation of the linear actuator 60. Without limitation, the linear actuator 60 may be a Model 3100 Eagle® linear actuator manufactured and sold by Dresser Energy Valve Division of the Halliburton Corp. of Houston, Tex. It comprises an electric motor gear driven device wherein the electric motor turns a gear set which, in turn, rotates a screw coupled to the inside of the actuator rod. The screw is arranged to rotate without rotating the rod. As the screw rotates, the rod moves in and out relative to the screw. Limits which is in the actuator are used to control the extent of travel of the rod.

Because of the manner in which the linear actuator is coupled between the clevis arm 56 and the bracket 54, a 24-inch stroke by the linear actuator is sufficient to raise the barrier arm 44 to a position parallel to the pole 42.

In FIG. 2, the barrier arm 44 is shown in its lowered, traffic-blocking disposition. Upon command from a remote radio transmitter, relay contacts (not shown) are actuated to apply AC power to the linear actuator 60 to cause it to extend and thereby apply a torque to the assembly causing the barrier arm 44 to rotate upward in a counterclockwise direction as viewed in FIG. 2 until it assumes its raised position that is generally parallel to the pole 42. Channel brackets 62 and 64 are clamped by U-bolts 66 and 68 to the pole 42 to receive the barrier arm when raised and serve as restraints against lateral movement of the raised barrier arm 44 due to wind forces.

The Model 3100 Eagle linear actuator is charged with a lubricant at the time of manufacture and no further lubrication is needed. However, because the barrier assembly is exposed to below freezing temperatures, it has been found expedient to include an electrically-powered heating element to maintain the lubricant at an elevated temperature. As another precaution, a thermal switch is provided in the unit so that the motor driving the cylinder is protected in the event of an inordinately high load that resists movement of the barrier arm.

To render the barrier arm 44 highly visible, especially at night, appropriately colored lights, as at 70, are mounted on the barrier arm and are arranged to come on when the barrier arm 44 is being lowered to its traffic-blocking, horizontal disposition.

As will be further discussed herein below, also mounted on the top of the pole 42 is a video camera 72, which is aimed so as to be able to view any vehicle that is attempting to circumvent the lowered barrier arm by driving around it.

Referring momentarily again to FIG. 1, the gates 26–32 are connected by under-road wiring to existing light poles used to illuminate the interchange at night. This wiring is represented in FIG. 1 by dotted lines leading from light poles identified by symbols illustrated in the associate key in FIG. 1. The electrical power derived from the existing lighting structures facilitates installation of the traffic control system of the present invention at existing freeway intersections with a minimum of effort and expense.

Located a predetermined distance uproad of the mainline gate 30 are one or more radio-controlled warning signs that when flashing or illuminated serve to advise drivers that the interchange they are coming to is closed and that all traffic must exit the freeway. These warning signs are represented by the open triangle symbol as at 80 and 82 in FIG. 1. Likewise, traffic approaching the freeway interchange along the northbound lane 14 of the highway will be advised by a warning sign 84 located a predetermined distance uproad of the freeway entrance ramp 24 to advise oncoming motorists that the freeway is shut down. A similar radio-controlled sign 86 is associated with the southbound lane 20 of the highway for the same reason.

Without limitation, there may be two advanced warning signs for each mainline of the freeway, with one being located approximately 1,000 feet from the gate location and the other approximately 2,000 feet uproad of the freeway exit ramp. These signs may be solar powered with solar energy being used to charge DC batteries which are coupled in circuit with radio-controlled relay contacts all contained within the sign housing or base structure.

Referring still to FIG. 1, radio-controlled video cameras are mounted atop existing light poles at the interchange and positioned to view the mainline gates 30 and 32. The light pole having a video camera for observing the gate 30 is identified by the symbol 90 while the light pole having a camera mounted thereon for observing the gate 32 is identified by symbol 92. The ramp gates 26 and 28 are also adapted to be observed by video cameras mounted on existing light poles identified by the symbols 94 and 96, respectively. Without limitation, the cameras employed may be AUTOSCOPE® video detection devices available from Image Sensing Systems, Inc. of St. Paul, Minn. These devices are capable of transmitting wireless, full-motion video and have been used in the past for traffic management and law enforcement applications. When used in combination with an electromechanical pan/tilt base module available from Quickset International, Inc. of Northbrook, Ill., under radio control, the camera can be made to sweep vertically and laterally under control of a broadcast radio signal. The AUTOSCOPE camera has circuitry for detecting movement based upon image comparison techniques and in the case of the present invention creates an alarm signal when a violation occurs due to a motorist driving around or through a closed barrier gate.

Figure 3:
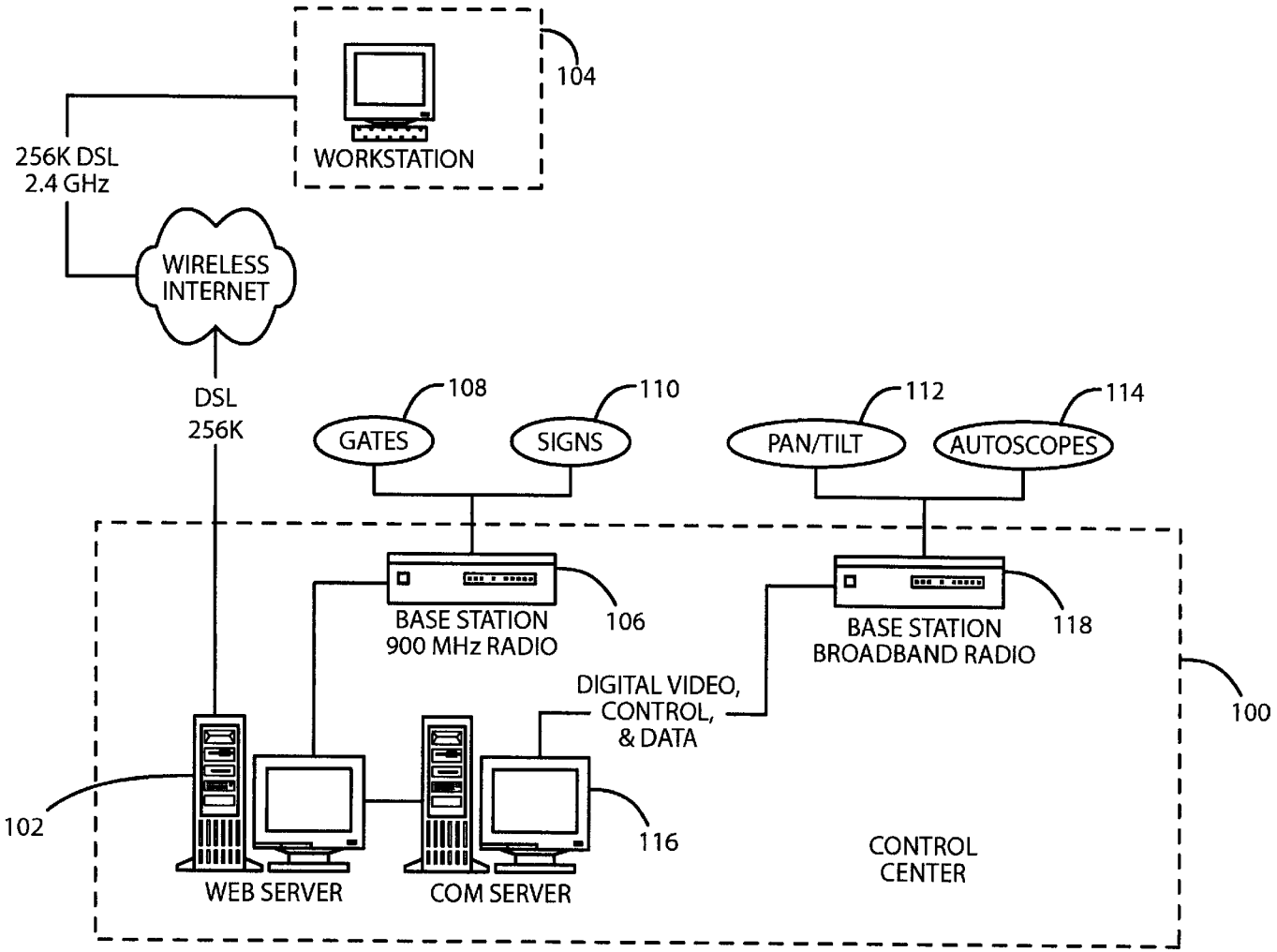
FIG. 3 is a block diagram representation of the control and monitor subsystem for the radio-controlled gates, signs and video cameras.
Figure 4:
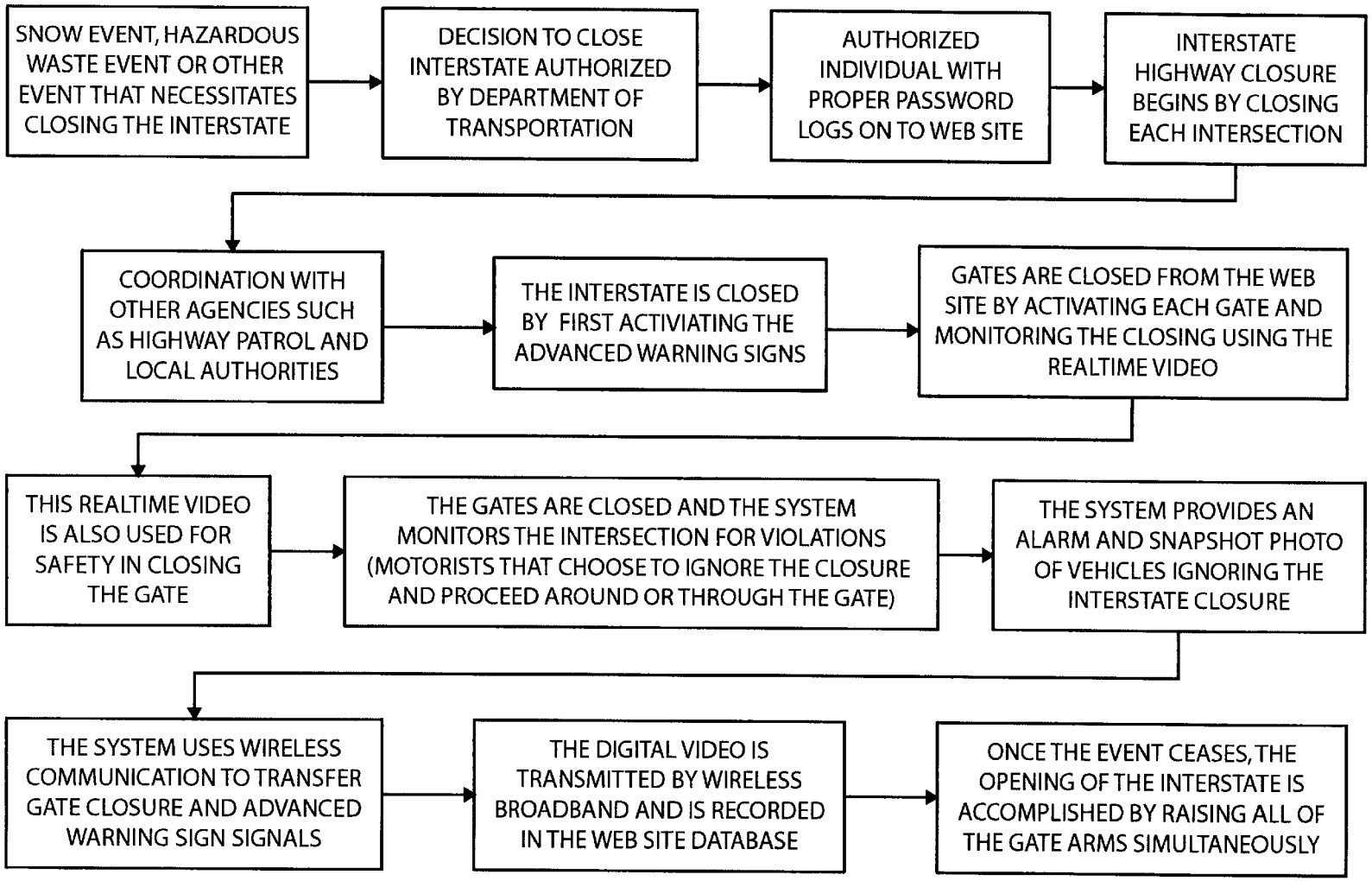
FIG. 4 is an operations flow diagram for the system.

Turning now to FIG. 3, there is illustrated a block diagram representation of the control and monitor subsystem used with the radio-controlled gates, signs and video cameras embodied in the freeway interchange traffic rerouting control system of the present invention. Located within a control center 100, which is within radio range of the intersection being controlled, is a web server comprising a commercially available PC 102 running software on Internet-connected computers. Web server software is available from Microsoft Corporation as well as from several other companies. The web server 102 will typically incorporate an ability for the system to recognize Internet addresses and to create software that links a web browser to a central data base. The web server 102 may be connected to the Internet via a wireless DSL connection and is used as the principal source for control and monitoring of a given freeway interchange from a remote site equipped with a workstation, as at 104, in FIG. 3.

The web server 102 is connected in controlling relation to a base station radio 106. This base station transceiver may be physically located at the control center 100 or may be remote therefrom so as to be in range with receivers associated with the gates, warning signs and video cameras. It preferably comprises a 900 MHz spread spectrum design, which uses wide band, noise-like signals to modulate the carrier. The modulated output signals from the radio then occupy a significantly greater bandwidth compared to the signal's base band information bandwidth. As such, the system is less subject to jamming. The base station radio transceiver 106 transmit encoded data to radio receivers in the barrier gates 108 and in the signs 110 and in the AUTOSCOPE video camera and the QUICKSET tilt/pan unit. By using a wireless communication, there is no need for costly fiber-optic or copper transmission lines between the control center and the equipment at the interchange being controlled. Furthermore, the use of spread spectrum technology allows the use of radio-frequency spectrum without applying for specific licenses from the FCC. Without limitation, the Communicator™ brand 900 MHz spread spectrum transceiver available from Intuicom, Inc. of Boulder, Colo., is well suited for use in the system of the present invention. The Intuicom Communicator can be networked to operate in several modes, including point-to-point, point-to-multipoint and Time Division Multiple Access which allows a plurality of users to access a single RF channel without interference in that each user is given a unique time slot within each channel. In the present application, one master transceiver located at the server site may control a plurality of slave transceivers located at a given intersection for controlling the gates and signs at that intersection. The system allows the gates and signs to be signaled individually or in groups. The slave transceivers are contained in a rigid cast aluminum housing that is hermetically sealed and, therefore, well suited to outdoor applications.

Not only is a communication link needed to control the raising and lowering of the gates at the interchange and to appropriately control the warning signs, but also the communication link employed must be able to send control commands to the pan/tilt motors associated with selected ones of the AUTOSCOPE cameras as indicated by oval 112 in FIG. 3. It also must be able to feed real-time video data streams from the AUTOSCOPES 114 back to the workstation 104, via the wireless Internet connection. In this regard, there is also provided a communications server 116 that is coupled to the web server 102. Using the Real Time Streaming Protocol (RTSP), the server 111 is able to deliver video in real time. The communications server 116 connects to a broadband radio 118. The broadband radio 118 may typically comprise a 5.0 GHz broadband radio available from Motorola Corporation, which has the capability of relaying video data streams from the cameras 114 and over the Internet, via the communications server 116 and the web server 102. The video feeds from the four cameras disposed at the interchange (See FIG. 1), when fed via the broadband radio 118, allows the communications server 116 to compress and translate the digital video to the workstation 104, allowing the video streams to be viewed by an operator either one at a time or all four at once when operating in a quad mode.

The data and control signals to the video cameras (AUTOSCOPES) 114 and the pan/tilt platforms on which they are mounted utilize the same spread spectrum radio signal functioning in a point-to-multipoint mode.

Figure 5:
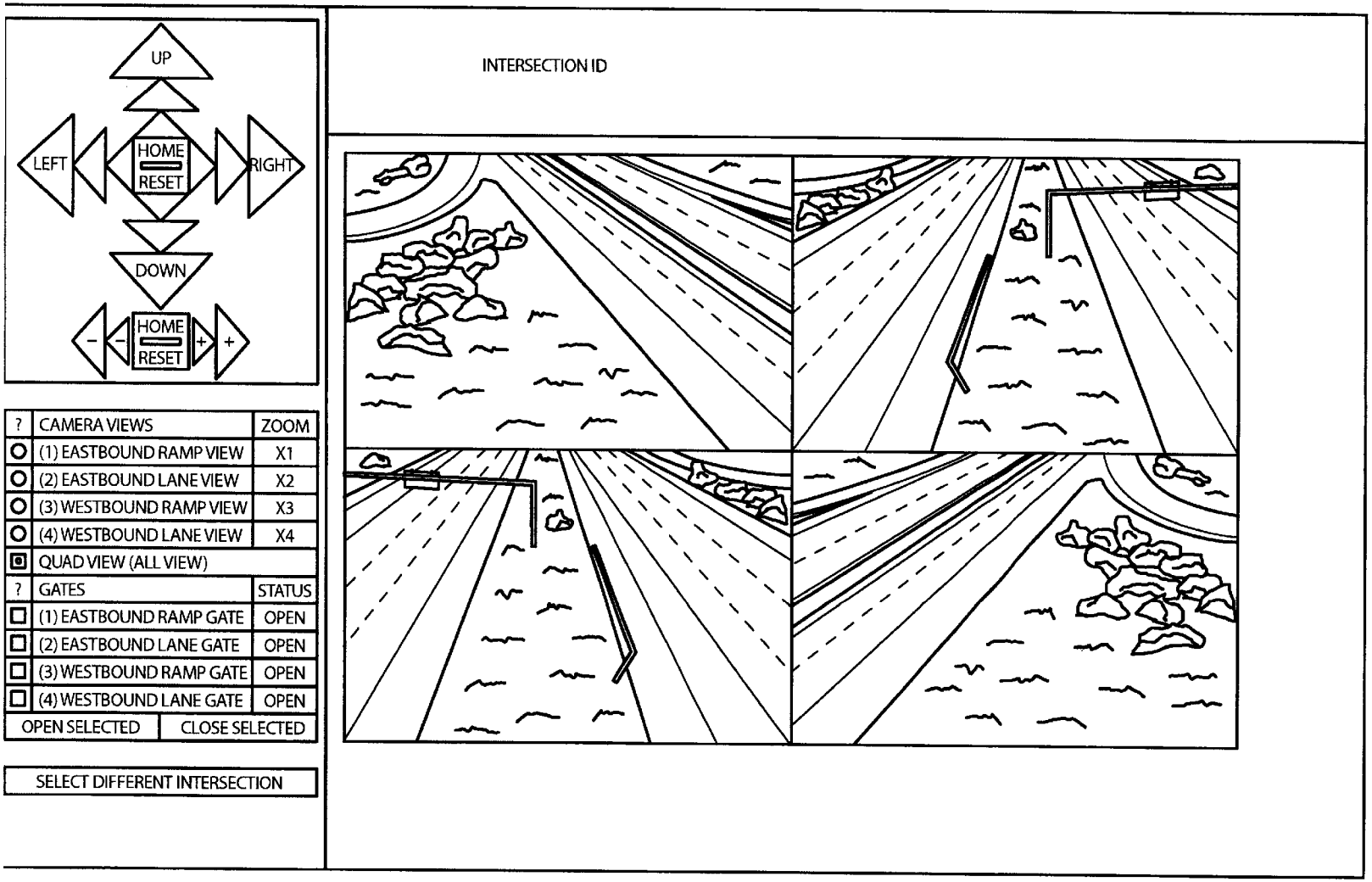
FIG. 5 is the graphics user interface appearing on the workstation screen at the control center.

As is reflected in the flow diagram of FIG. 5 should an event such as a heavy snowstorm or any other event necessitating closure of a section of an interstate freeway occur, a decision is made by an official of the State Department of Transportation who may phone or otherwise contact an operator at the central site 100 to initiate closure.

Each of the gates and signs at the interchange has its own URL address. The authorized system operator at the workstation 104 logs on to the Internet and enters a password to be able to go to the designated website. The system requires that the operator enter a log in name and password so that only authorized personnel can control the shutting down and subsequent opening of a freeway interchange using the system of the present invention. Once the system operator has successfully entered the website, he/she will have access to a display screen (FIG. 5) that provides a graphics user interface allowing selection of the individual ramp and mainline gates by "clicking" a box to the left of the gate ID's and then operation (open/closed).

At the same time, the operator may view the video stream from one or all of the video cameras at the interchange by selecting a particular camera view from a given camera or by selecting the "quad view" mode that is illustrated in FIG. 5. The "pan/tilt" and "zoom" features are controlled using a virtual "joy stick" displayed on the GUI screen at the upper left corner. Thus, by clicking the mouse appropriately on the virtual "joy stick", the speed and direction of panning, tilting and zooming are controlled. The software is also such that by clicking on a "home" button, the selected video camera is returned to a default viewing position.

As mentioned, the closing/opening of the each of the gates is executed by clicking on the buttons contained on the graphical user interface screen. The associated advanced warning signs are turned on when the gate barrier arm closing command is initiated. In the same manner, the signs are turned off when the gate arm is raised upon reopening of the freeway.

In the event an alarm is given due to a driver circumventing a barrier, the contents of a digital buffer will be captured such that five frames prior to the alarm and five frames after the alarm will be stored whereas to provide a snapshot of the event.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A freeway interchange traffic rerouting control system comprising:

(a) a plurality of motorized, radio-controlled gates, each having a barrier arm movable between a raised disposition and a lowered, traffic-blocking disposition, a first pair of said plurality of gates having barrier arms adapted to span first and second entrance ramps of said freeway when in their lowered disposition and a second pair of said plurality of gates having barrier arms adapted to span oppositely directed freeway driving lanes when in their lowered disposition, the second pair of gates being positioned immediately downstream of a pair of freeway exit ramps; and (b) a control center having an INTERNET connection to a communications server for permitting authorized persons to cause predetermined signals to be transmitted by the radio transmitter to said plurality of radio-controlled gates for controlling the movement of the barrier arms between their raised and lowered disposition.

2. The freeway interchange traffic rerouting control system as in claim 1 and further including:

(a) a radio-controlled sign located upstream of the interchange by a predetermined distance and actuated to provide a warning message to vehicle drivers when at least one of said radio-controlled gates receives a signal to move its barrier arm to its lowered disposition.

3. The freeway interchange traffic rerouting control system as in claim 2 wherein the radio-controlled sign receives signals from the same radio transmitter that sends the signals to the radio-controlled gates.

4. The freeway interchange traffic rerouting control system as in claim 1 and further including:

(a) a plurality of video cameras placed to view each of the oppositely directed freeway driving lanes and said entrance ramps; and (b) a broadband radio link for transmitting video data from the plurality of video cameras to a communications server having a connection to the INTERNET.

5. The freeway interchange traffic rerouting control system as in claim 1 wherein the radio transmitter comprises a transceiver adapted to receive status messages from the radio-controlled gates for routing same to said control center.

6. The freeway interchange traffic rerouting control system as in claim 2 and further including a time delay circuit for actuating the radio-controlled gate a predetermined time following actuation of the radio-controlled sign.

7. The freeway interchange traffic rerouting control system as in claim 1 wherein the motorized radio-controlled gates comprise:

(a) a vertically disposed mounting pole, the barrier arm being pivotally hinged proximate one end thereof to said mounting pole at a predetermined height above the roadway surface; and (b) a linear actuator operatively coupled between the mounting pole and the barrier arm;

(c) a motor coupled in driving relation to the linear actuator for raising and lowering the barrier arm; and (d) a radio receiver responsive to signals from the radio transmitter for connecting electrical power to the motor.

8. A freeway interchange traffic rerouting control system comprising:

(a) a plurality of motorized, radio-controlled gates, said gates being individually positioned at a freeway interchange to selectively block traffic flow on freeway entrance ramps and on freeway driving lanes while allowing traffic flow on freeway exit ramps;

(b) a plurality of radio-controlled freeway status warning signs positioned along the driving lanes a predetermined distance up road of the freeway interchange;

(c) a control center having a workstation for sending messages over the INTERNET to a first radio transmitter, said transmitter broadcasting motor control signals to said motorized, radio-controlled gates and to said freeway status warning sings as specified by said messages;

(d) a plurality of monitoring video cameras disposed at said interchange and positioned to view scenes including the plurality of gates; and (e) a radio transceiver for transmitting signals representing video images from the plurality of cameras to the control center over the INTERNET.

9. The freeway interchange traffic rerouting control system as in claim 8 and wherein the video cameras include pan, tilt, and zoom controls actuatable by signals transmitted from the control center over the INTERNET to said transceiver.

10. The freeway interchange traffic rerouting control system as in claim 9 and further including:

(a) a detector in said video cameras for detecting an occurrence of vehicle circumventing one of said gates and a video capture buffer for storing a predetermined number of frames of video data prior to, during, and following such occurrence; and (b) means including the transceiver for transmitting the captured frames of video data to the workstation at the control center over the INTERNET.

* * * * *